US008033321B2

(12) United States Patent
Brost et al.

(10) Patent No.: US 8,033,321 B2
(45) Date of Patent: Oct. 11, 2011

(54) HEAT EXCHANGER AND METHOD OF MANUFACTURING

(75) Inventors: Viktor Brost, Aichtal (DE); Rainer Kaesinger, Haiterbach (DE); Ivo Agner, Buehl (DE); Oliver Noehl, Buehlertal (DE); Johannes Arnold, Achern (DE)

(73) Assignees: Schaeffler Technologies GmbH & Co. KG, Herzogenaurach (DE); Modine Manufacturing Company, Racine, WI (US)

( * ) Notice: Subject to any disclaimer, the term of this patent is extended or adjusted under 35 U.S.C. 154(b) by 436 days.

(21) Appl. No.: 12/229,109

(22) Filed: Aug. 20, 2008

(65) Prior Publication Data

US 2009/0056913 A1 Mar. 5, 2009

Related U.S. Application Data

(63) Continuation of application No. PCT/DE2007/000297, filed on Feb. 15, 2007.

(30) Foreign Application Priority Data

Feb. 25, 2006 (DE) ..... 10 2006 008 857

(51) Int. Cl.

| | |
|---|---|
| ***F24H 3/00*** | (2006.01) |
| ***B60H 1/00*** | (2006.01) |
| ***F01N 5/02*** | (2006.01) |
| ***F28D 11/00*** | (2006.01) |
| ***F16D 65/853*** | (2006.01) |
| ***F16D 65/10*** | (2006.01) |
| ***F16D 31/00*** | (2006.01) |

(52) U.S. Cl. ..... 165/47; 165/41; 165/51; 165/86; 165/168; 165/169; 188/264 R; 188/264 F; 192/58.64; 192/113.3

(58) Field of Classification Search ..... 165/41, 165/51, 47, 86, 168, 169, 177, 181, 182; 188/264 R, 264 D, 264 F, 264 CC; 192/58.64, 192/70.12, 85.61, 113.1, 113.3, 113.31, 113.34
See application file for complete search history.

(56) References Cited

U.S. PATENT DOCUMENTS

| | | | | |
|---|---|---|---|---|
| 4,198,819 | A | 4/1980 | Bourne | |
| 4,633,938 | A | 1/1987 | Schunck et al. | |
| 4,893,391 | A | 1/1990 | Zobel et al. | |
| 5,931,218 | A * | 8/1999 | Carlson et al. | 165/47 |
| 6,691,831 | B1 | 2/2004 | Furuya | |
| 2003/0192684 | A1 | 10/2003 | Roberts et al. | |

FOREIGN PATENT DOCUMENTS

| | | |
|---|---|---|
| DE | 2825813 | 1/1979 |
| DE | 3104945 | 4/1982 |
| DE | 3315304 | 10/1984 |
| DE | 3721257 | 1/1989 |
| EP | 1677064 | 7/2006 |
| JP | 2002106953 | 4/2002 |
| WO | WO 9827367 | 6/1998 |
| WO | WO 2007/012312 | 2/2007 |

* cited by examiner

*Primary Examiner* — Ljiljana Ciric
*Assistant Examiner* — Travis Ruby
(74) *Attorney, Agent, or Firm* — Simpson & Simpson, PLLC

(57) ABSTRACT

A heat exchanger comprising at least one pipe (1) and at least one lamina (2), for exchanging heat between a first coolant that flows through the pipe (1) and a second coolant that wets the heat exchanger under the influence of centrifugal forces in order to be cooled and to be available to further cool a rotating machine element (3) that is situated in a housing (4). The heat exchanger is of approximately ring-shaped design, essentially surrounds the rotating machine element (3) and is integrated into the housing (4).

12 Claims, 4 Drawing Sheets

HEAT EXCHANGER AND METHOD OF MANUFACTURING

CROSS REFERENCE TO RELATED APPLICATIONS

This application is filed under 35 U.S.C. §120 and §365(c) as a continuation of International Patent Application PCT/DE2007/000297, filed Feb. 15, 2007, which application is incorporated herein by reference in its entirety. This application also claims priority from German Patent Application No. 10 2006 008 857.3, filed Feb. 25, 2006, which application is incorporated herein by reference in its entirety.

FIELD OF THE INVENTION

The invention relates to a heat exchanger, comprising at least one pipe and at least one lamina, for exchanging heat between a first coolant and a second coolant, which serves to cool a rotating machine element. In addition, the invention relates to a suitable method of manufacturing the heat exchanger.

BACKGROUND OF THE INVENTION

Numerous heat exchangers are known from the existing art, and are often designed in a ring shape. In most applications, ring-shaped heat exchangers serve to cool a first coolant flowing through the flat piping of the heat exchanger by means of cooling air that is blown by a fan or the like from inside to outside (or vice versa) through cooling ribs situated between the flat pipes.

Likewise in most cases the flat pipes have been bent on their narrow sides, so that a plurality of flat pipes can be situated side-by-side and the laminae or the cooling ribs for the radially flowing cooling air can be placed between them. One example among numerous others was described in DE 37 21 257 C2 which is herein incorporated by reference in its entirety.

A ring-shaped heat exchanger has also already been proposed, whose flat pipes have been bent on their wide sides, which is more easily accomplished in terms of production technique. In this case, however, the cooling air flows axially through the laminae situated between the flat pipes. One such example can be found in DE 3 104 945, FIG. 4. DE 3 104 945 is herein incorporated by reference in its entirety.

Ring-shaped heat exchangers have often been equipped with round or slightly oval pipes, which are easier to bend than flat pipes. The lamellae there are usually flat ribs that have openings through which the pipes have been inserted before being bent. With round pipes the surfaces involved in the heat exchange are smaller than with flat pipes, which worsens their efficiency.

Rotating machine elements may be, for example, clutches or brakes that have a need for cooling. Torque transmitting elements have been addressed, for example,—frequently referred to as wet clutches—that run through a coolant sump, in most cases containing oil, and that fling the coolant away by their rotation. The coolant then runs down the wall of the housing, for example, back into the sump, and there can cool down. There are also numerous publications in this field.

BRIEF SUMMARY OF THE INVENTION

The object of the invention is to provide a heat exchanger for cooling a coolant flung off by a rotating machine element, with which efficient cooling can be achieved. The intent is to contribute to the ability to increase the transmission of power by means of the machine element while keeping the construction space small.

The present invention broadly comprises a heat exchanger comprising at least one pipe (1) and at least one lamina (2), for exchanging heat between a first coolant that flows through the pipe (1) and a second coolant that wets the heat exchanger under the influence of centrifugal forces in order to be cooled and to be available to further cool a rotating machine element (3) that is situated in a housing (4), wherein the heat exchanger is of approximately ring-shaped design, essentially surrounds the rotating machine element (3) and is integrated into the housing (4).

The heat exchanger comprises at least one pipe, preferably a flat pipe, and at least one lamina, and serves to exchange heat between a first coolant, which flows through the flat pipe, and a second coolant, which wets the heat exchanger under the influence of centrifugal forces. The second coolant is cooled thereby and is available to further cool a rotating machine element that is situated in a housing, whereby the heat exchanger is of approximately ring-shaped design, essentially surrounds the rotating machine element, and is integrated into the housing.

A heat exchanger designed and situated in this manner enables active and effective cooling of the second coolant, and thus contributes both to the ability to increase the transmission of power by means of the rotating machine element and the ability to reduce the quantity or space requirement of the second coolant while maintaining the same performance. The greater quantities of heat loss that occur with greater transmission of power, caused chiefly by friction, are transferred effectively to the first coolant and dissipated. The space requirement of the ring-shaped heat exchanger in the housing is relatively small. The expression "ring-shaped" as used in the present proposal is not intended to mean only circular, but rather to include any contour that is suitable for essentially surrounding the rotating machine element. About half of the circumference of the machine element at least should be enclosed by the heat exchanger. Preferably, however, the heat exchanger extends around at least nearly the entire circumference of the machine element and is integrated into the latter's housing.

According to an advantageous aspect, it is further provided that at least one flat pipe is designed to be bent on its wide sides, with the lamina being situated on the wide side that faces inward. This is the side that is wetted by the second coolant. It is known to be simpler to bend flat pipes along their wide sides. The wide sides of the flat pipe are thus situated approximately parallel to the axis of rotation of the machine element.

It is readily possible to employ a plurality of flat pipes lying side-by-side, bent on their wide sides.

It is also possible to employ one or more flat pipes with ribs situated in the intervals between the flat pipes, with the flat pipes bent on their narrow sides.

Another aspect provides that the lamina is provided with a jacket provided with openings, which extends approximately parallel to the wide side of the flat pipe and covers the lamina. The jacket is for example a sheet metal strip. That increases the intensity of the heat exchange.

The openings are designed and situated so that the second coolant can flow as far as the lamina and as far as the wide side of the flat pipe, and can flow out of the lamina again. The coolant can also flow out on the narrow sides of the lamina or at its longitudinal edges, because the edges do not have to be enclosed by the covering. As a result, the retention time of the second coolant in the lamina or on the flat pipe is prolonged, and it can be cooled more intensively.

The second coolant flows into a sump or similar collecting pan, in which it can be reached by the rotating machine element.

Situated on at least one end of the at least one flat pipe is an end chamber for supplying or carrying off the first coolant.

Preferably end chambers are provided on both ends of the at least one flat pipe.

Furthermore, it is also advantageous if straps or similar connecting elements are provided on at least one of the end chambers, in order to connect the two end chambers together.

It is advantageous in terms of manufacturing if the at least one flat pipe, in which the first coolant flows, is either a soldered or welded flat pipe with an inner insert or a flat pipe manufactured by means of an extrusion process. The lamina has a wave-type contour, with numerous cuts at offset positions in the wave flanks, with the waves running perpendicular or obliquely to the direction of extension of the pipe. Such laminae are known from the field of "oil cooling." This lamina acts in conjunction with the jacket described above. The jacket is preferably a sheet metal covering that is soldered together with the lamina and the pipe.

The invention also broadly comprises a method for manufacturing a heat exchanger from at least one flat pipe and at least one lamina contains the following procedural steps:

a) placing a lamina on the wide side of the at least one flat pipe;

b) affixing end chambers to the end of the flat pipe;

c) joining the parts by metal material;

d) bending the flat pipe-lamina assembly in order to produce a ring-shaped heat exchanger; and, e) inserting the ring-shaped heat exchanger into a housing in order to cool the coolant of a rotating machine element.

In one embodiment, a jacket with openings can be placed on the lamina.

The end chambers can be joined with each other in the course of assembly.

BRIEF DESCRIPTION OF THE DRAWINGS

The invention will be described below in an exemplary embodiment with reference to the accompanying drawings. Additional advantageous features and effects can be contained in this description.

DETAILED DESCRIPTION OF PREFERRED EMBODIMENTS OF THE INVENTION

Figure 2:
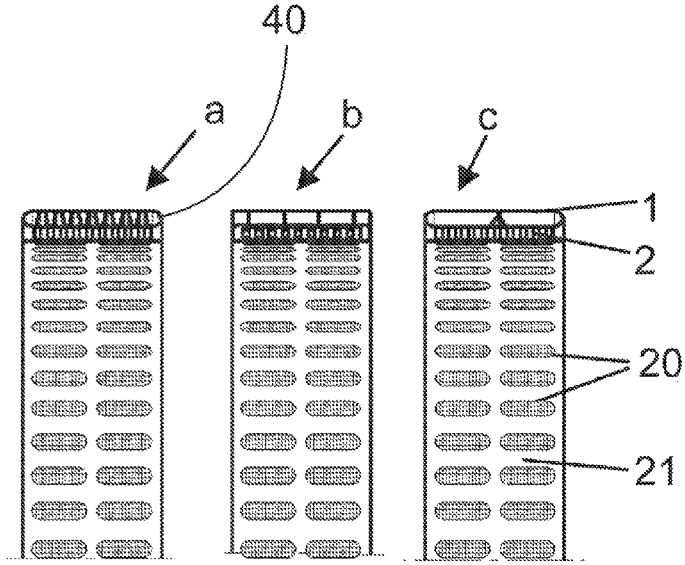
FIG. 2 shows three details from the heat exchanger with different pipes.

The heat exchanger shown in the exemplary embodiment is made up of a single flat pipe 1 and a lamina 2. The flat pipe 1 was bent into a ring shape on the wide sides 10, with an approximately circular ring-shaped form being shown in the exemplary embodiment, although the form can be adapted to almost any shape. A favorable manufacturing process for the heat exchanger provides that a straight flat pipe 1 is first joined to a lamina 2. There can be an inner insert in flat pipe 1, in accordance with the left-hand illustration a in FIG. 2. The middle illustration b is intended to be an extruded multi-chamber pipe, and the right-hand illustration c is a flat pipe with an inner flange.

Figure 3:
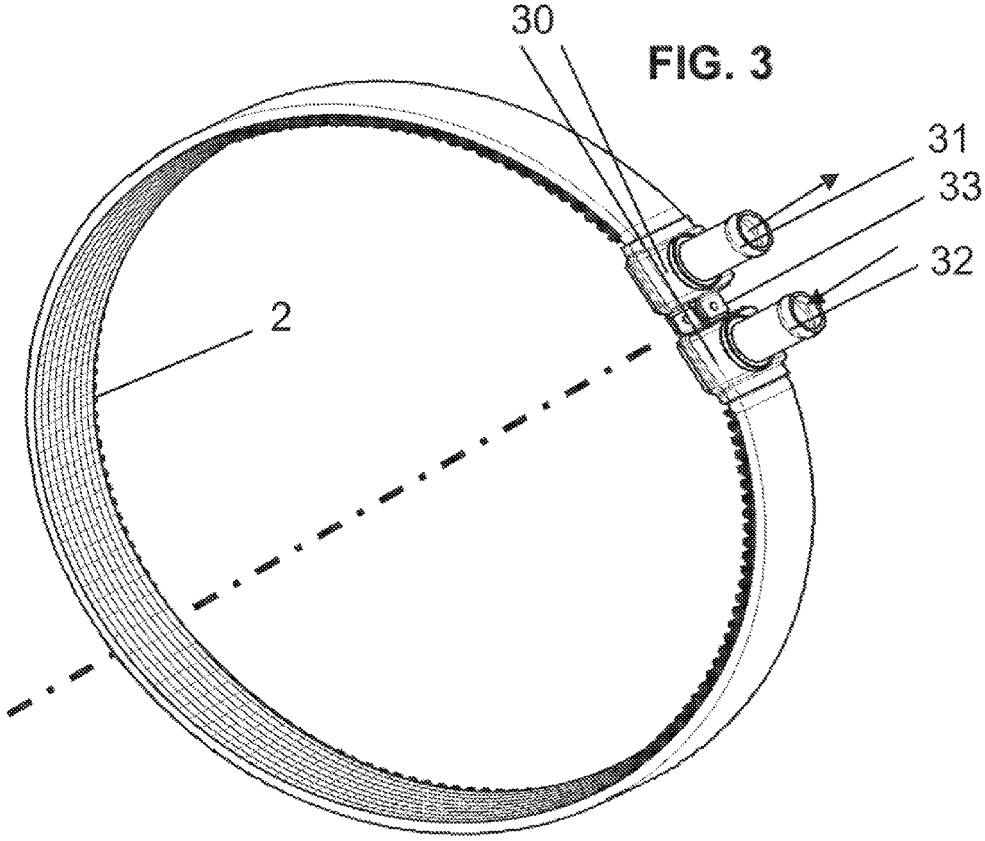
FIG. 3 shows the ring-shaped heat exchanger in perspective representation.

An end chamber 30 is attached at each end of flat pipe 1, as well as an inlet connection 31 on the one end chamber 30 and an outlet connection 32 on the other end chamber 30. However, depending on the intended flow-through pattern of flat pipe 1, a single end chamber 30 with a partition could also be provided at one end of flat pipe 1. The other end of flat pipe 1 would then simply be closed, with an outbound path and a return path then being designed for the first coolant. A lamina 2 is then placed on a wide side 10 of flat pipe 1. In addition, a cover strip 21 likewise of aluminum sheet can be added or mounted on the other side of lamina 2 as a jacket. Cover strip 21 runs approximately parallel to the wide sides 10 of flat pipe 1, and it has numerous openings 20. The construction is next joined together in a brazing process. The construction is then formed into the needed shape essentially by bending, by means of a known stretch bending method. FIG. 3 shows a heat exchanger with an approximately circular shape. The shape could also be oval, however, or could have extensions, with the stretch bending process being augmented by appropriate work steps in order to create the extensions (not shown).

Figure 1:
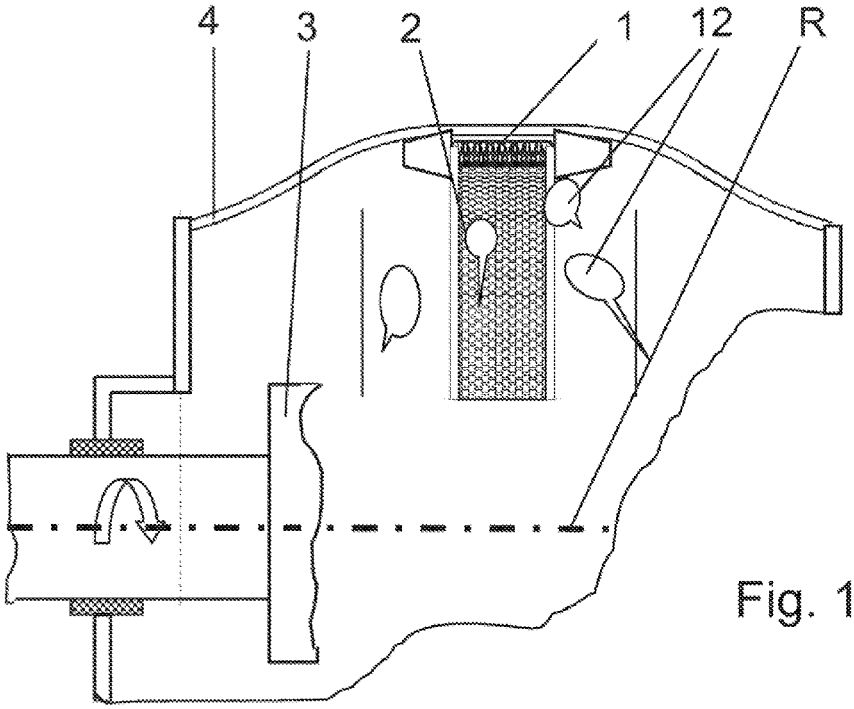
FIG. 1 is a cut-away view of the inside of a housing showing the principle of how the heat exchanger is integrated into the housing.

FIG. 1 depicts a detail from the overall construction, from which part of the housing 4 and also part of the rotating machine element 3 can be recognized. Housing 4 surrounds rotating machine element 3. The heat exchanger has been inserted into housing 4 and attached. The wide side 10 facing inward, on which the lamina 2 and (in the exemplary embodiment) also the sheet metal covering 21 are located, faces rotating machine element 3.

The inlet and outlet connections 31, 32 for the first coolant can be connected outside of housing 4 to a hose connection or the like (not shown). Also not shown is an oil sump, into which rotating machine element 3 is immersed. The oil is the second coolant, which cools rotating machine element 3. The oil is flung away by the rotation, which is shown by way of suggestion in FIG. 1 by means of just a few drops 12. The oil to be cooled flows through the openings 20 into the chamber in which the lamina 2 is located, is cooled intensively, and then flows down again into the sump (not shown).

Figure 4:
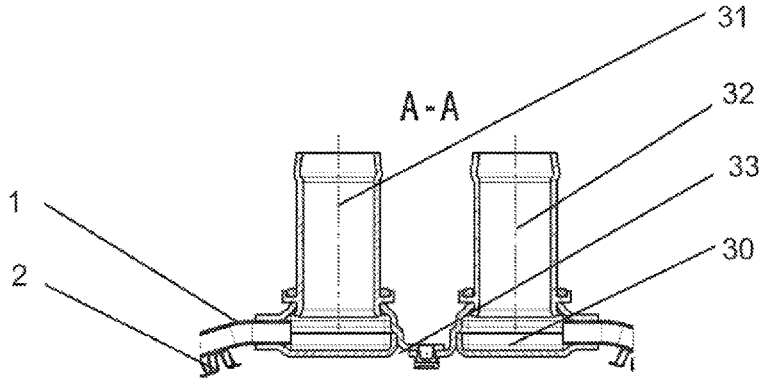
FIGS. 4 and 5 show details in the area of the end chambers of the heat exchanger.
Figure 5:
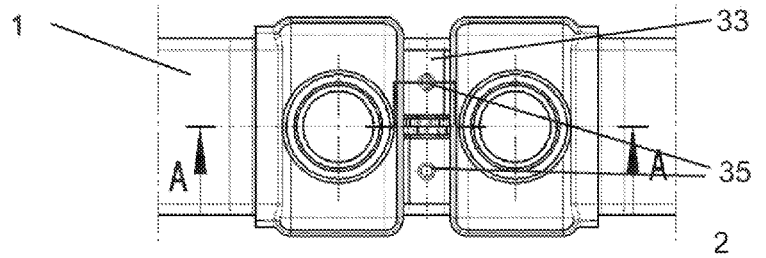

On the end chambers 30 are straps 33, which can be connected to each other so that a relatively stable heat exchanger construction results. For details about this point see FIGS. 4 and 5. The connection between the straps 33 can be made, for example, by means of clinching. Such connections are known by specialists in the field as TOX connections. The two straps lie one on top of the other. The material located under the face of the die is then pressed into an undercut in the lower strap. Only two TOX points 35 have been shown. This type of connection is simple, quick and reliable.

Figure 6:
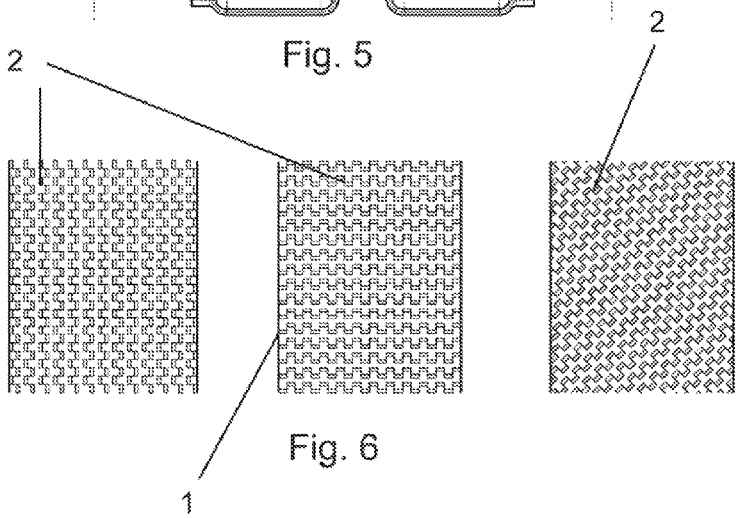
FIG. 6 shows three possible arrangements of the lamina.
Figure 7:
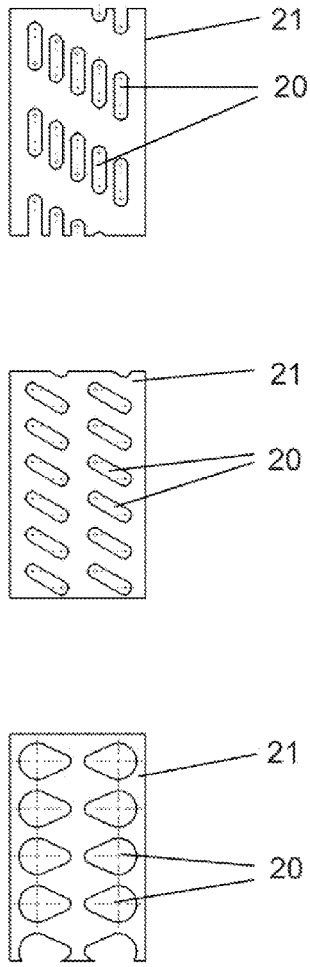
FIG. 7 shows possible designs of the jacket.

FIG. 6 shows the use of a lamina from the area of oil cooling in use as the rippled lamina 2. In the illustration on the left the arrangement of the ripples runs in the horizontal direction. In the middle illustration the ripples run vertically, i.e., in the direction of extension of flat pipe 1. In the illustration on the right the direction of the ripples has been shown skewed by about 45° from the longitudinal direction. Simple and inexpensive measures like these can be used to influence the exchange of heat in a desired manner. FIG. 7 shows three exemplary illustrations that differ in the shape and arrangement of the openings 20. The proportion of area of the openings 20 relative to the rest of the jacket 21 also differs. The intent is to cause the oil to remain in contact with lamina 2 and flat pipe 1 for a longer time.

What is claimed is:

1. A heat exchanger system comprising a rotating machine element situated in a housing; at least one pipe (1) and at least one lamina (2) for exchanging heat between a first coolant that flows through the pipe (1) at least one and a second coolant that wets the heat exchanger under the influence of centrifugal forces in order to be cooled and to be available to further cool the rotating machine element (3), wherein the heat exchanger is of ring-shaped and, essentially surrounds the rotating machine element (3) and is furthermore integrated into the housing (4); and, wherein the at least one pipe (1) is a flat pipe having a width side facing inward towards the rotating machine element that is curved on a length side of said at least one pipe (10), the lamina (2) being attached to the width side facing inward towards the rotating machine element, and the width side of the at least one pipe (10) situated substantially parallel to the axis of rotation (R) of the rotating machine element.

2. The heat exchanger system according to claim 1, wherein the lamina (2) is provided with a jacket (21) having openings (20), the openings (20) extending parallel to the width side (10) of the at least one flat pipe.

3. The heat exchanger system according to claim 2, wherein the openings (20) are designed and situated so that the second coolant can flow into the lamina (2) and across the width side (10) of the at least one flat pipe, and can flow out of the lamina (2).

4. The heat exchanger system according claim 1, further comprising at least two end chambers (30) wherein at least one of said at least two end chambers (30), is situated at each ends of the at least one flat pipe (1).

5. The heat exchanger system according to claim 4, wherein one or more straps are situated on at least one of the end chambers (30) in order to join the two end chambers (30) together.

6. The heat exchanger system according to claim 1, further comprising a sump wherein the second coolant flows into said sump, such that said second coolant can be reached by the rotating machine element.

7. The heat exchanger system according to claim 1, wherein an end chamber (30) for supplying and removing the first coolant is situated at one end of the at least one flat pipe (1).

8. The heat exchanger system according to claim 1, wherein the at least one flat pipe (1) in which the first coolant flows is either a soldered or a welded flat pipe (1) with an inner insert (40) or a flat pipe manufactured by an extrusion process.

9. The heat exchanger system according to claim 1, wherein the lamina (2) has a rippled contour with numerous cuts at offset positions with ripples running perpendicularly to or obliquely to the pipe (1) at least one.

10. A method for producing a heat exchanger system from at least one flat pipe and at least one lamina, said at least one flat pipe having two ends a width side, and end chambers, said method comprising the steps of:

a) placing a lamina on the width side of the at least one flat pipe;

b) affixing said end chambers to the ends of the at least one flat pipe;

c) joining the end chambers to said ends using metal material;

d) curving the flat pipe-lamina assembly in order to produce a ring-shaped heat exchanger;

e) providing a rotating machine element in a housing; and, f) inserting the ring-shaped heat exchanger into the housing in order to cool a coolant of the rotating machine element.

11. The method according to claim 10, wherein step a) includes placing a jacket (21) provided with openings on the outer side of the lamina (2).

12. The method according to claim 10, wherein the end chambers (30) are joined together by one or more straps situated on at least one end of the chambers (30).

* * * * *